US008736509B2

(12) United States Patent
Shoji

(10) Patent No.: US 8,736,509 B2
(45) Date of Patent: May 27, 2014

(54) MULTIBAND ANTENNA AND RADIO COMMUNICATION TERMINAL

(75) Inventor: Hideaki Shoji, Chiba (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 261 days.

(21) Appl. No.: 12/473,682

(22) Filed: May 28, 2009

(65) Prior Publication Data

US 2009/0322618 A1 Dec. 31, 2009

(30) Foreign Application Priority Data

Jun. 25, 2008 (JP) ..... 2008-166421

(51) Int. Cl.
*H01Q 1/50* (2006.01)

(52) U.S. Cl.
USPC ..... 343/860

(58) Field of Classification Search
CPC ..... H01Q 1/243; H01Q 1/38; H01Q 9/42; H01Q 5/0003; H03H 7/38
USPC ..... 343/860, 745, 749, 702, 861, 853
See application file for complete search history.

(56) References Cited

U.S. PATENT DOCUMENTS

| | | | | |
|---|---|---|---|---|
| 6,774,850 | B2 * | 8/2004 | Chen | 343/700 MS |
| 7,230,575 | B2 * | 6/2007 | Jeong | 343/702 |
| 7,782,261 | B2 * | 8/2010 | An et al. | 343/702 |
| 7,834,814 | B2 * | 11/2010 | Xie et al. | 343/749 |
| 2003/0142022 | A1 * | 7/2003 | Ollikainen et al. | 343/702 |
| 2004/0075614 | A1 | 4/2004 | Dakeya et al. | |
| 2004/0095280 | A1 | 5/2004 | Poilasne et al. | |
| 2005/0190107 | A1 * | 9/2005 | Takagi et al. | 343/702 |
| 2007/0268191 | A1 * | 11/2007 | Ishizuka et al. | 343/702 |
| 2008/0055173 | A1 * | 3/2008 | Chominski | 343/741 |

FOREIGN PATENT DOCUMENTS

| | | |
|---|---|---|
| CN | 1496610 A | 5/2004 |
| CN | 101202376(A) | 6/2008 |
| JP | 55-145405 | 11/1980 |
| JP | 09-046259 | 2/1997 |
| JP | 11-031913 | 2/1999 |
| JP | 2004-266311 | 9/2004 |
| JP | 2006-311246 | 11/2006 |
| JP | 2006-319477 | 11/2006 |
| WO | WO 2007/138157 A1 | 12/2007 |
| WO | WO 2008/059316 A1 | 5/2008 |

OTHER PUBLICATIONS

Office Action issued Mar. 16, 2012, in Chinese Patent Application No. 200910150908.X with English translation.
Office Action issued in Feb. 22, 2012, in Japanese Patent Application No. 2008-166421.
Chinese Third Office Action issued Jan. 25, 2013 in Chinese Application No. 200910150908.X with English translation.

* cited by examiner

*Primary Examiner* — Huedung Mancuso
(74) *Attorney, Agent, or Firm* — Oblon, Spivak, McClelland, Maier & Neustadt, L.L.P.

(57) ABSTRACT

A multiband antenna includes at least two antenna elements for use in a low frequency band and a high frequency band, a feeding point unit configured to be shared by both of the antenna elements for use in the low frequency band and the high frequency band and an impedance matching unit configured to be inserted into and connected to a position between an end of the antenna element for use in the high frequency band on the side of the feeding point unit and an open end thereof.

7 Claims, 6 Drawing Sheets

MULTIBAND ANTENNA AND RADIO COMMUNICATION TERMINAL

BACKGROUND OF THE INVENTION

1. Field of the Invention

The present invention relates to a multiband antenna having an antenna element which splits into, for example, two or more branches and a radio communication terminal using the multiband antenna.

2. Description of the Related Art

As an example of a multiband antenna, a dual band antenna of what is called a two-branch (two-branch antenna element) configuration, for example, having a single feeding point and configured to be operable in two bands is well known.

FIG. 11 shows a schematic structural example of an existing dual band antenna of the two-branch and single-feeding-point configuration.

The dual band antenna shown in FIG. 11 has first and second antenna elements 101 and 102 and one feeding point 104. One end of each of the first and second antenna elements 101 and 102 is formed into an open end and the other end of each antenna element is connected to the single feeding point 104. The antenna length of the first antenna element 101 is different from that of the second antenna element 102. For example, in the case that the antenna length of the second antenna element 102 is shorter than that of the first antenna element 101, the first antenna element 101 operates as an antenna on the side of a low frequency band and the second antenna element 102 operates as an antenna on the side of a high frequency band.

The dual band antenna of the configuration shown in FIG. 11 is basically constructed such that respective branches resonate at respective frequencies in the above mentioned two bands. However, it is constructed such that the feeding point is commonly used by the antenna elements, so that one antenna element operates as an open stub of the other antenna element. In addition, in the case of the antenna of the configuration shown in FIG. 11, the antenna elements on the lower frequency band side and the higher frequency band side are capacitive-coupled together in their respective operation bands, so that it is not the case that the antenna elements operate completely independently.

In addition, as an existing multiband antenna configured to cope with a plurality of bands, for example by using a single antenna element, there is also well known an antenna in which an LC parallel resonance circuit is provided on an intermediate part of an antenna element. In the case that the LC parallel resonance circuit is provided on the intermediate part of the antenna element, its impedance is open-circuited at a resonance frequency of parallel resonance, so that current hardly flows to the open end side of the antenna element beyond the LC parallel resonance circuit. That is, the antenna of this configuration is an antenna of the type utilizing such a phenomenon that the antenna element seems to be electrically short at a frequency on the high band side and configured to widen the band, in particular, on the high frequency side. Incidentally, the LC parallel resonance circuit used in this structural example operates similarly to what is called a trap (wave trap) circuit. In many cases, the above mentioned LC parallel resonance circuit is designed to be open-circuited on the high band side and is installed at a position apart from the feeding point by an amount corresponding to $\lambda/4$ ($\lambda$ is a wavelength) the high band side frequency.

In addition, for example, in a mobile phone terminal of what is called a GSM (Global System for Mobile Communications) system, an antenna whose wide-band characteristics may be demanded in a frequency band on the high band side is adopted so as to cope with a triple band of 900 MHz/1800 MHz/1900 MHz. Further, recently, there has been also adopted an antenna configured to cope with the UMTS (Universal Mobile Telecommunications System) band 1 (Tx: 1920-1980 MHz, Rx: 2110-2170 MHz) of the third generation mobile phone standard (3GPP). Specifically, an antenna configured such that a parasitic element having the quarter-wavelength $\lambda/4$ relative to a high band side frequency is disposed in the vicinity of a two-branch antenna element so as to attain a plurality of tunings has been widely adopted.

In addition, for example, Japanese Laid-Open Patent Publication No. 2004-266311 discloses an antenna including a linear main radiating conductor section having one end constituting a feeding end and the other end constituting an open end and a linear short-circuiting conductor section which branches from an intermediate part of the main radiating conductor section in a T-shaped form and is connected to a grounding conductor. In the above mentioned antenna, the distribution route of antenna current is constituted by a first route running from one end to the other end of the main radiating conductor section, a second current route running from one end of the main radiating conductor section to the grounding conductor via a T-shaped branch and a third route turning back from the other end of the main radiating conductor section to the grounding conductor. Owing to this arrangement, in the above mentioned antenna, at least two resonance frequency bands are obtained at frequencies other than higher harmonics.

SUMMARY OF THE INVENTION

Incidentally, as the above mentioned GSM system, there are a GSM850 (850 MHz band) system mainly used in the USA and a GSM900 (900 MHz band) system mainly used in Europe. In addition, existing GSM system mobile phone terminals are configured to cope with any one of the GSM 850 system and the GSM 900 system with respect to the bands from 800 MHz to 900 MHz on the low band side.

However, recently, it has been realized to cope with both of the above mentioned bands using a single RF circuit. As a result, mobile phone terminals coping with both of the above mentioned GSM 800 system and the GSM 900 system have been widely used mainly in high-grade types. However, it may not be favorable to widen the frequency band on the low band side of as low as 800 MHz to 900 MHz, for example, by using a plurality of antenna elements, because a large physical volume may be necessary for installation of the antenna elements. In addition, with the mobile phone terminals of the type coping with both of the above mentioned GSM 850 system and GSM 900 system, actually, mobile phone terminals are used in different areas such as the USA and Europe and such a situation may not occur that both of the GSM 850 system and the GSM 900 system are simultaneously used. Thus, in the mobile phone terminals of the type coping with the above two systems, a technique of widening a frequency band on the low band side using a plurality of antenna elements is not used and a system (a tunable antenna) of switching bands, for example, using an RF switch is adopted.

On the other hand, for coming mobile phone terminals, an antenna of the type coping with a larger number of frequency bands so as to cope with various systems in various areas may become necessary. In addition, further size and thickness reduction of mobile phone terminals may be demanded as ever. As mentioned above, aiming at coping with a plurality of frequency bands simultaneously with attaining size and thickness reduction of terminals, the requirements for characteristics on the low band side may become strict, in particular, in antennas. That is, imaging to realize the size and thickness reduction of terminals together with band widening of antennas used, in general, the degree of difficulty of widening the band toward the low band side is higher than that of widening the band toward the high band side due to a limitation on design of antennas. Therefore, development of antennas allowing the size and thickness reduction of terminals and realizing favorable wide-band characteristics on the low band side has been expected.

The present invention has been proposed in view of the above mentioned circumstances. Accordingly, it is desirable to provide a multiband antenna configured to realize favorable wide-band characteristics, in particular, on the low band side and a radio communication terminal using the above mentioned multiband antenna.

According to an embodiment of the present invention, in a multiband antenna having at least two antenna elements for use in low and high bands (hereinafter, referred to as a low (frequency) band antenna element and a high (frequency) band antenna element) and a feeding point unit configured to be shared by both of the antenna elements, an impedance matching unit is inserted into and connected to a position between one end of the high band antenna element on the feeding point unit side and its open end, thereby solving the above mentioned problems.

That is, according to an embodiment of the present invention, the impedance matching unit is inserted into and connected to, in particular, the high band antenna element of the low band antenna element and the high band antenna element which are connected to one feeding point unit, thereby making the antenna element tune to a frequency on the low band side, while making the antenna element operate as the high band antenna element.

According to an embodiment of the present invention, in a multiband antenna having a low band antenna element and a high band antenna element, an impedance matching unit is inserted into and connected to the high band antenna element so as to make the antenna element operate as the high band antenna element and to make the antenna element tune to a frequency on the low band side simultaneously, thereby realizing favorable wide-band characteristics on the low band side.

DESCRIPTION OF THE PREFERRED EMBODIMENTS

Next, preferred embodiments of the present invention will be described with reference to the accompanying drawings.

In a description of preferred embodiments of the present invention, as an example of an embodiment of the present invention, a multiband antenna mounted on a mobile phone terminal which is a typical example of a radio communication terminal is given. Incidentally, it should go without saying that the content described hereinbelow is merely an example and the present invention is not limited thereto. In addition, a mobile phone terminal according to an embodiment of the present invention is the same as a general mobile phone terminal except that a multiband antenna according to an embodiment of the present invention is mounted thereon as an antenna. Therefore, in the description of the preferred embodiments of the present invention, illustration and description of a general configuration of a mobile phone terminal will be omitted.

[Schematic Configuration of Multiband Antenna]

Figure 1:
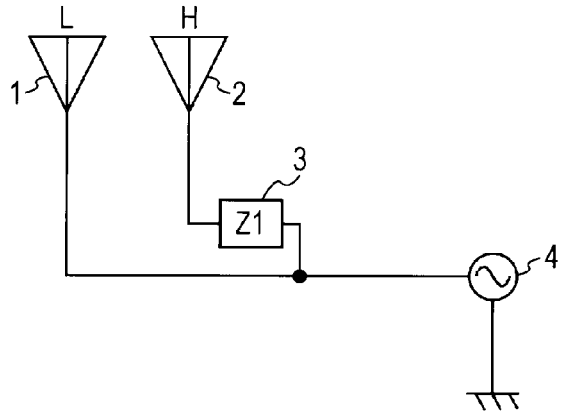
FIG. 1 is a circuit diagram showing a schematic structural example of a multiband antenna according to an embodiment of the present invention.
Figure 2:
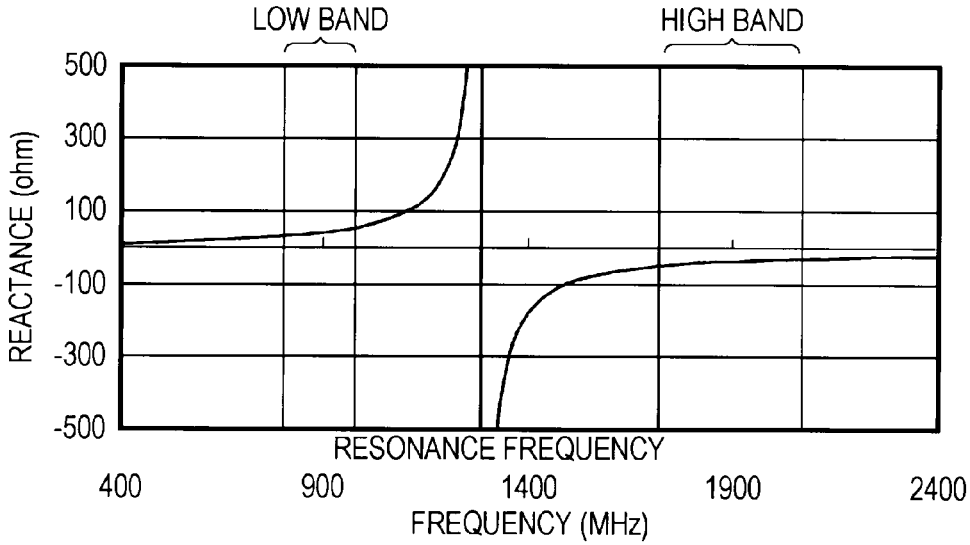
FIG. 2 is a characteristic diagram showing reactance-frequency characteristics attained by an LC parallel resonance circuit of an impedance matching circuit according to an embodiment of the present invention.

FIG. 1 shows a schematic configuration of a multiband antenna according to an embodiment of the present invention.

The multiband antenna according to an embodiment of the present invention illustrated in FIG. 1 is a dual band antenna having two branches (two-branch antenna elements) and is configured by including first and second antenna elements 1 and 2 and one feeding point 4.

Both of the first and second antenna elements 1 and 2 are opened at one ends thereof and are connected to the single feeding point 4 at the other ends thereof. The antenna length of the first antenna element 1 is different from that of the second antenna element 2. For example, if the antenna length of the second antenna element 2 is shorter than that of the first antenna element 1, the first antenna element 1 will serve as a low frequency band antenna and the second antenna element 2 will serve as a high frequency band antenna.

The multiband antenna according to an embodiment of the present invention of the configuration shown in FIG. 1 has such a structure that, basically, respective branches (antenna elements) resonate at respective frequencies in the above two bands. However, the feeding point is shared by the antenna elements, so that one antenna element serves as an open stub of the other antenna element. In addition, in the case of the antenna having the configuration shown in FIG. 1, the low band antenna element and the high band antenna element are respectively capacitive-coupled together in their operation bands, so that it is not the case that the antenna elements operate completely independently of each other.

In the multiband antenna according to an embodiment of the present invention, an impedance matching circuit (Z1) 3 is inserted into and connected to the second high frequency band antenna element 2. That is, the impedance matching circuit (Z1) 3 is inserted into and connected to a position between one end of the second antenna element 2 connected to the feeding point 4 and the open end thereof.

The above mentioned impedance matching circuit 3 is constituted by a parallel-connected LC resonance circuit. Its resonance frequency is set to be almost exactly between a low band and a high band such that it operates as an inductor on the low band side and operates as a capacitor on the high band side.

That is, in a state in which an impedance matching circuit 3 is not present, a second high band antenna element 2 hardly operates as an antenna on the low band side due to its too short electric length relative to the frequency on the low band side. On the other hand, an embodiment of the present invention is configured such that the impedance matching circuit 3 is inserted into and connected to the high band antenna element so as to make the impedance matching circuit 3 operate as an inductor, so that the electric length of the second antenna element 2 seems to be long. In addition, in an embodiment of the present invention, the inductance value of the impedance matching circuit 3 is optimized and hence the second high band antenna element 2 is tuned to a frequency even on the low band side.

Therefore, according to the multiband antenna of an embodiment of the present invention, even if, for example, it is difficult for the first low band antenna element 1 to maintain a sufficient distance from the ground, radiation from the second high band antenna element 2 will be allowed and hence the antenna efficiency will be ensured. In other words, the multiband antenna according to an embodiment of the present invention is configured such that it seems as though two low band antenna elements are installed.

Incidentally, although in the configuration shown in FIG. 1, illustration of a matching circuit is omitted, in reality, the matching circuit is also installed.

In addition, although in an embodiment of the present invention, the inductance and the capacitance of the LC parallel resonance circuit are respectively set at fixed values, the inductance and the capacitance may be varied by using, for example, a variable inductor and a variable capacitor.

[Experimental Production of Antenna and Verification of Antenna Characteristics]

Figure 3:
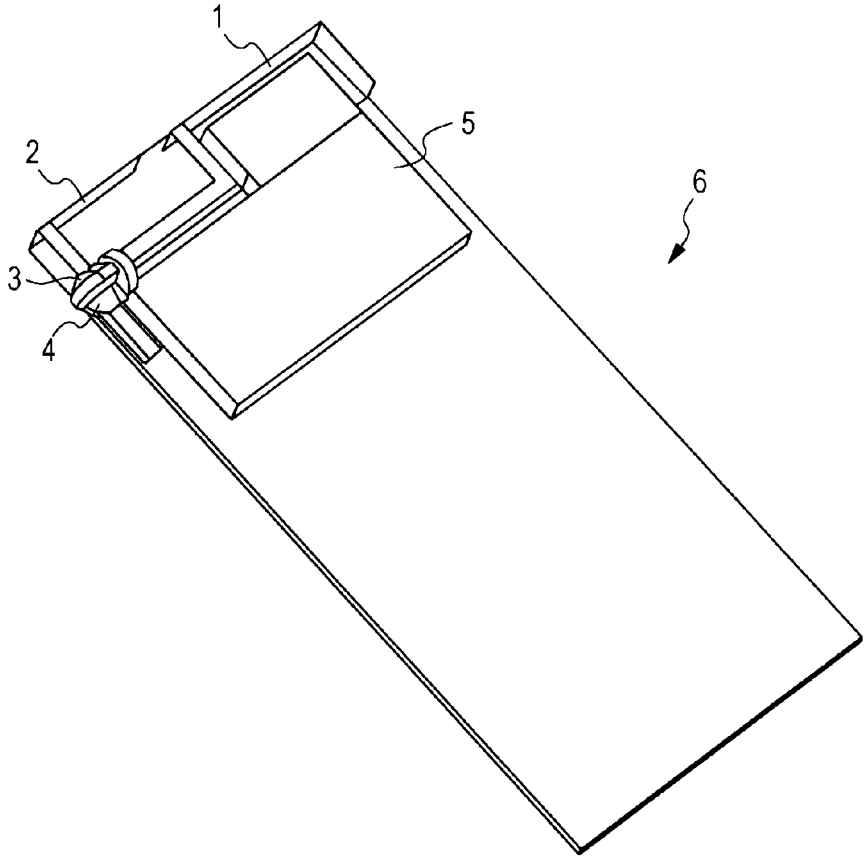
FIG. 3 is a diagram showing an experimental example of a multiband antenna according to an embodiment of the present invention.

FIG. 3 shows an experimental example of the multiband antenna according to an embodiment of the present invention shown in FIG. 1.

In FIG. 3, the first antenna element 1 and the second antenna element 2 are installed, for example, on one end side of a circuit board 6 of a mobile phone terminal and the first antenna element 1 is disposed in the vicinity of a ground section 5 of the circuit board 6.

The antenna length of the first antenna element 1 is made longer than that of the second antenna element 2, one ends of the elements are open-ended and the other ends thereof are connected to the feeding point 4. Incidentally, the impedance matching circuit 3 is inserted and connected between the second antenna element 2 and the feeding point 4.

Figure 4:
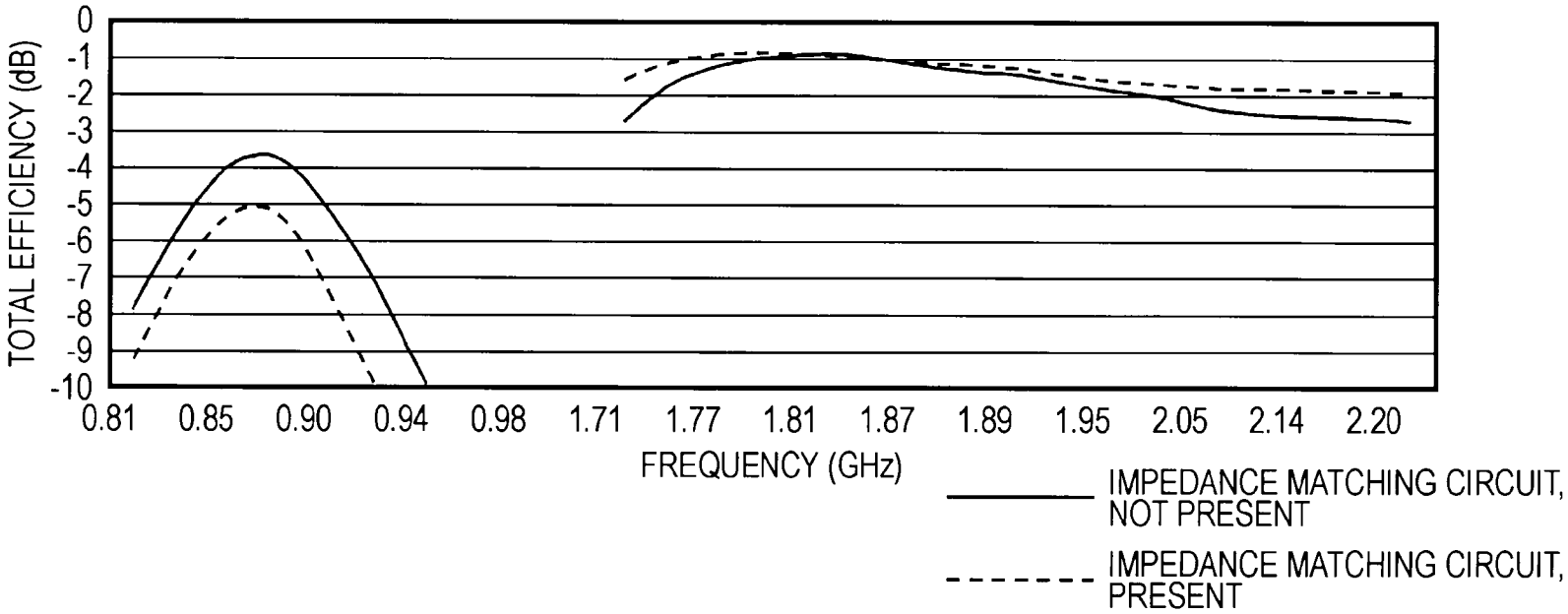
FIG. 4 is a characteristic diagram showing frequency-antenna characteristics attained when verification has been performed by electromagnetic field simulation using an experimental multiband antenna.

FIG. 4 shows a diagram of frequency-antenna characteristics obtained when verification has been performed by electromagnetic field simulation using the experimental multiband antenna shown in FIG. 3. Note that a characteristic curve shown by the solid-line in FIG. 4 indicates the case where an impedance matching circuit is not present and a characteristic curve shown by the broke-line in FIG. 4 indicates the case where the impedance matching circuit is present.

As can be seen from the characteristic diagram in FIG. 4, according to the antenna having the configuration in FIG. 3, it may be confirmed that the efficiency at frequencies on the low band side is increased. Incidentally, the example shown in FIG. 4 is of the diagram showing characteristics obtained when the experimental antenna shown in FIG. 3 has been used, so that there exists a band where the efficiency may be partially reduced on the high band side. However, the reason therefor lies in that the resonance circuit has seemed to be a capacitor and hence impedance matching has slightly deviated. Therefore, if matching is again performed, the reduction of efficiency will become little to such an extent that any problem will not occur. In this case, as an example of matching again the impedance, a method of making the antenna length of the second high band antenna element 2 longer to gain the inductance, thereby cancelling the capacitance proportion by the gained inductance may be conceived of.

[Other Structural Examples]

FIGS. 5 to 10 show other structural examples of the multiband antenna according to an embodiment of the present invention.

Figure 5:
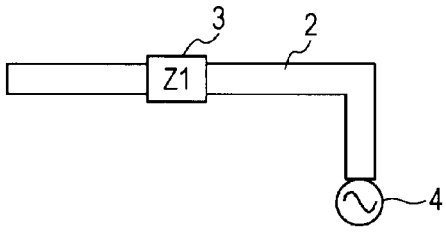
FIG. 5 is a diagram showing a structural example in which an LC parallel resonance circuit is inserted into and connected to the vicinity of an intermediate part of a second antenna element according to an embodiment of the present invention.

In the example shown in FIG. 1, the LC parallel resonance circuit (the impedance matching circuit 3) is inserted into and connected to the root (a part near the feeding point 4) of the second antenna element 2. As an alternative, the LC parallel resonance circuit may be inserted into and connected to the vicinity of an intermediate part of the second antenna element 2 as shown in FIG. 5. Note that the illustration of the first antenna element is omitted in FIG. 5.

There is made a difference in the capacitance observed on the high band side between the structural example shown in FIG. 5 and the case where the LC parallel resonance circuit is inserted into and connected to the root of the second antenna element as shown in FIG. 1. That is, in a general type antenna in which the resonance circuit is installed at a position apart from the feeding point by the amount corresponding to $\lambda/4$ the high band side frequency, the current flows the most in the vicinity of the feeding point. Thus, if the capacitor of the LC parallel resonance circuit enters the vicinity of the feeding point concerned, the frequency will greatly change. On the other hand, the current hardly flows toward the open end side of the antenna, so that as the installation position of the LC parallel resonance circuit comes closer to the open end, the amount of the capacitance observed on the high band side is more decreased and hence a change of frequency is more decreased.

Therefore, the configuration in which the impedance matching circuit 3 is inserted into a position apart from the feeding point 4 as shown in FIG. 5 may be desirably adopted in the case where the capacitance observed on the high band side is decreased to decrease the change of frequency.

Incidentally, if the impedance matching circuit is inserted into and connected to a position near the feeding point 4, there will be realized a configuration in which the capacitance is not observed on the high band side while gaining the impedance on the low band side. Thus, in an embodiment of the present invention, the structural example shown in FIG. 1 is used.

In addition, the multiband antenna according to an embodiment of the present invention is not limited to a two-branch (two-branch element) antenna and may be of the type having a plurality of branches such as three or four branches. The multiband antenna having the plurality of branches may be capable of coping with a wider frequency band than the two-branch antenna.

Figure 6:
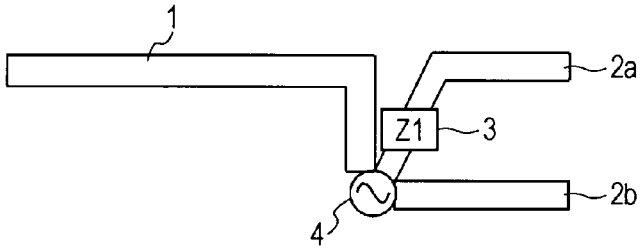
FIG. 6 is a diagram showing a structural example of a three-branch (three-branch-element) antenna having one low band antenna element and two high band antenna elements, in which an LC parallel resonance circuit is inserted into and connected to one of the high band antenna elements according to an embodiment of the present invention.

As an example of the antenna having the plurality of branches as mentioned above, in an antenna having three branches (three-branch elements) as shown in FIG. 6, one antenna element 1 is used in a low band, two other antenna elements 2*a* and 2*b* are used in high bands and the antenna elements 1, 2*a* and 2*b* are connected to one feeding point 4. Then, in this example, the impedance matching circuit (the LC parallel resonance circuit) 3 is inserted into and connected to any one of the high band antenna elements 2*a* and 2*b* in the vicinity of the feeding point.

Figure 7:
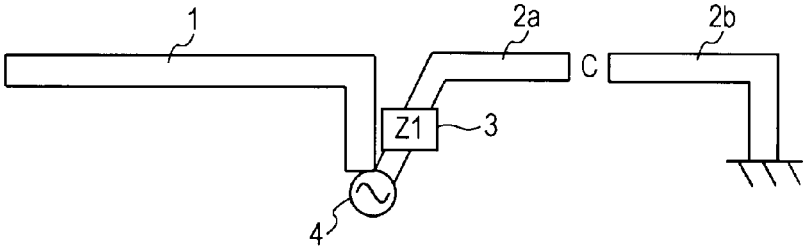
FIG. 7 is a diagram showing a structural example of an antenna having a low band antenna element and a high band antenna element which shares one feeding point with each other, and a grounded high band antenna element, in which an LC parallel resonance circuit is inserted into and connected to the high band antenna element on the side of the feeding point according to an embodiment of the present invention.

As an alternative, the multiband antenna having one antenna element used in a low band and two antenna elements used in high bands may be also configured, for example, as shown in FIG. 7.

The multiband antenna shown in FIG. 7 includes one low band antenna element 1, two high band antenna elements 2*a* and 2*b* and one feeding point 4. The low band antenna element 1 and any one (the element 2*a* in the example shown in FIG. 7) of the two high band antenna elements 2*a* and 2*b* are connected to the single feeding point 4. The other antenna element 2*b* of the two high band antenna elements 2*a* and 2*b* is grounded and the other end (an open end) thereof is disposed near an open end of the antenna element 2*a* with a space interposed therebetween and both the open ends are capacitive-coupled to each other. In the example shown in FIG. 7, the impedance matching circuit (the LC parallel resonance circuit) 3 is inserted into and connected to the high band antenna element 2*a* in the vicinity of the feeding point.

In addition, in the multiband antenna according to an embodiment of the present invention, the impedance matching circuit 3 to be inserted into and connected to the high band antenna element 2 may be constituted by what is called a strip line. In the case that the strip line is used, the impedance matching circuit 3 has a circuit structure having a planar conductor pattern. Thus, it may become possible to reduce the size of the structure and the cost involved to a greater extent than would be possible by using a general circuit element having a somewhat large volume.

Figure 8:
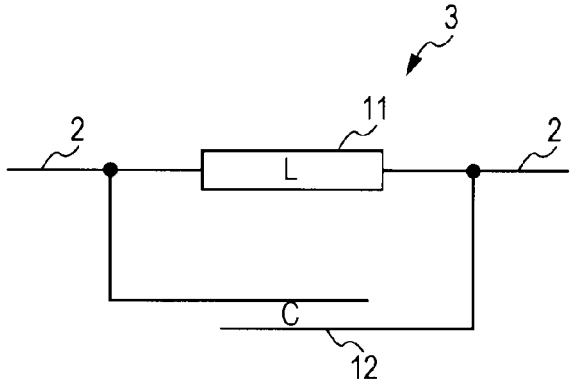
FIG. 8 is a diagram showing a structural example obtained when an LC parallel resonance circuit constituted by a strip line is inserted into and connected to a high band antenna element according to an embodiment of the present invention.

FIG. 8 shows a structural example in which the LC parallel resonance circuit (the impedance matching circuit 3) constituted by the strip line is inserted into and connected to the high band antenna element 2.

In the example shown in FIG. 8, the impedance matching circuit (the LC parallel resonance circuit) 3 has a configuration in which an inductor (L) 11 constituted by a conductor (a leading wire) and a capacitor (C) 12 constituted by conductors opposed to each other with a space interposed therebetween or with a dielectric installed in the space and sandwiched therebetween are disposed in parallel. The conductor (the leading wire) constituting the inductor 11 has a predetermined length sufficient to obtain a desired inductance. The space between the conductors constituting the capacitor 12 has a distance sufficient to obtain a desired capacitance.

In the multiband antenna according to an embodiment of the present invention, both the open ends of the low band antenna element and the high band antenna element may be disposed face to face with each other.

Figure 9:
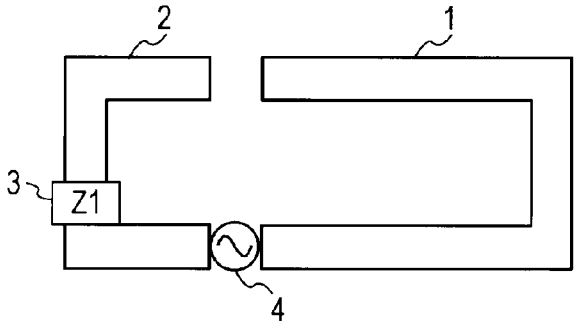
FIG. 9 is a diagram showing a structural example of an antenna in which a low band antenna element and a high band antenna element are disposed such that open ends of both of the antenna elements face each other according to an embodiment of the present invention.

FIG. 9 shows a structural example of an antenna in which both the open ends of the low band antenna element 1 and the high band antenna element 2 are disposed face to face with each other. Incidentally, the configuration of the antenna shown in FIG. 9 is the same as each of the above mentioned configurations in that one feeding point 4 is installed and the impedance matching circuit 3 is inserted into and connected to the high band antenna element 2.

In the case that both the open ends of the antenna elements are disposed face to face with each other as in the case with the example shown in FIG. 9, their open ends, that is, parts of the highest voltages (where currents hardly flow) face inward. Thus, the possibility that an object affecting the antenna characteristics such as a human finger comes near their open ends may be reduced.

In addition, although in the above mentioned embodiments of the present invention, the length of the high band antenna element is made somewhat longer to gain the inductance, thereby cancelling the capacitance proportion observed on the high band side, as another structural example, an inductor (L) may be serially inserted into the high band antenna element after the LC parallel resonance circuit to cancel the capacitance proportion by the inductance gained from the inductor. In this example, the necessity to adjust the length of the high band antenna element may be eliminated.

Figure 10:
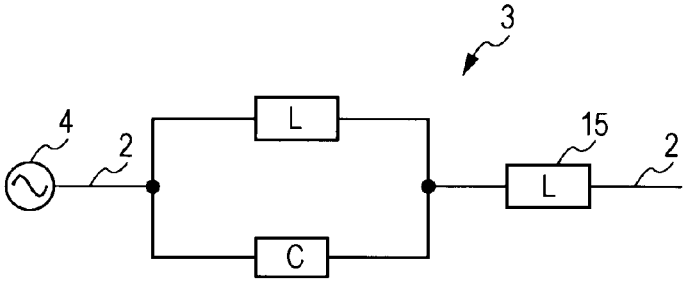
FIG. 10 is a diagram showing a structural example in which an inductor is serially connected after an impedance matching circuit (an LC parallel resonance circuit) according to an embodiment of the present invention.
Figure 11:
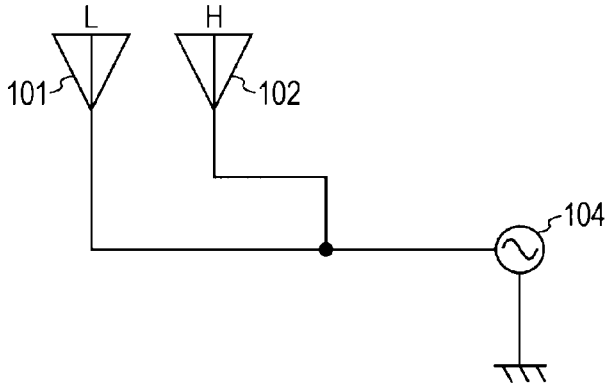
FIG. 11 is a circuit diagram showing a schematic structural example of an existing dual band antenna of a two branch and single feeding point configuration.

FIG. 10 shows a structural example in which an inductor (L) 15 is connected in series after the impedance matching circuit (the LC parallel resonance circuit) 3, that is, connected to a position between the circuit 3 and the open end of the antenna element 2.

[Conclusion]

According to an embodiment of the present invention, in a multiband antenna having antenna elements formed by splitting the antenna into two or more branches, an impedance matching mechanism is inserted into and connected to a high band antenna element. Then, the high band antenna element is tuned to a frequency even on the low band side using an impedance matching mechanism, while making the high band antenna element operate in its original high frequency band.

Owing to the above mentioned arrangement, it may become possible for the multiband antenna according to an embodiment of the present invention to increase the antenna efficiency on the low band side. That is, the physical space in which the antenna is to be installed is determined mainly depending on the size of the low band antenna element used. However, according to an embodiment of the present invention, even in the case where it is difficult to increase the size of the low band antenna element due to physical limitations as in the case where, for example, a space which may be utilized in a housing is limited, it may become possible to increase the antenna characteristics on the low band side. In other words, according to an embodiment of the present invention, it may be possible to reduce the size of the low band antenna element and hence another configuration (for example, a camera device) may be readily installed in a region formed owing to space saving of the antenna.

Incidentally, according to an embodiment of the present invention, a mounting area for the impedance matching circuit may be necessary. However, the mounting area for the impedance matching circuit is much smaller than the size of the antenna which would be necessary in the case that the desired low band characteristics are realized using the low band antenna element alone.

In addition, according to an embodiment of the present invention, owing to the provision of a plurality of antenna elements (the plurality of radiating elements), high fluctuation resistance to external environment such as, for example, a human body is attained.

The above description of respective embodiments of the present invention is merely an example of the present invention. Thus, it should go without saying that the present invention is not limited to the above embodiments and may be modified and altered in a variety of ways in accordance with requirements in design within the range of the technical concept relating to the present invention. The multiband antenna according to an embodiment of the present invention may be applicable not only to mobile phone terminals but also to other various radio communication devices.

Incidentally, in the related art, a mode of current resonating at three independent frequencies is generated and two of these three frequencies are made near-by to each other to realize band-widening. On the other hand, in a configuration according to an embodiment of the present invention, although three radiation modes (one low band antenna element and two high band antenna elements (for high-band and low-band operations) are prepared, the high band antenna elements are different from each other only in the operation frequency and have the same current mode. In this respect, the antenna according to an embodiment of the present invention may be different from the configuration of the related art.

In addition, according to an embodiment of the present invention, it may be possible to freely adjust the impedance of the high-band antenna element in the low band while maintaining the operation of the high band antenna element in the high band by making variable the combination of Ls (the inductors) with Cs (the capacitors) of the LC parallel resonance circuit to be inserted into and connected to the high band antenna element. That is, according to an embodiment of the present invention, owing to the serial installation of the LC parallel resonance circuit on the root of the high band antenna element, it may become possible to freely adjust the resonance frequency on the low band side which is attained using the high band antenna element concerned simply by selecting the value of the inductance of the LC parallel resonance circuit concerned. In addition, it may be possible to freely adjust the capacitance observed on the high band side in accordance with the constant of the LC parallel resonance circuit. Further, it may be possible to freely change the balance between the inductance and the capacitance by changing the combination of Q-sections of the LC parallel resonance circuit.

It should go without saying that in the case that replacement of L (the inductor) and C (the capacitor) of the LC resonance circuit with variable elements (for example, varicap diodes) is allowed, the inductance and the capacitance may be adjusted simply by changing the values of these variable elements. As described above, according to an embodiment of the present invention, the resonance frequency may be adjusted independently of the shape of the antenna used.

In the above mentioned related art, if the difference in length between current routes is lessened in order to make the resonance frequencies of the current routes (a) and (c) nearby to each other, the current route (b) of the antenna element which operates in the high frequency band may have to be changed and it might be unavoidable to set limits to the combination of the current routes to be physically lessened in length and the degree of making the resonance frequencies nearby to each other. In the related art, the antenna is not constructed to feed the antenna element directly from the feeding point and is limited to the type that the antenna element is excited with Cs (the capacity). In this respect, the related art may be different from an embodiment of the present invention. In addition to the above, there is well known a method of widening the band within which the antenna characteristics may be favorably exhibited by utilizing a matching circuit. On the other hand, in an embodiment of the present invention, instead of simply performing matching over a wide band, the antenna is constituted by the plurality of antenna elements and the high band antenna element is made operable both in the high and low bands. In general, it is well known to provide a plurality of high band antenna elements to widen the high band. On the other hand, in an embodiment of the present invention, the efficiency of the antenna in the low band is increased by using the high band antenna element. Such a technique as mentioned above is not yet known in the art.

The present application contains subject matter related to that disclosed in Japanese Priority Patent Application JP 2008-166421 filed in the Japan Patent Office on Jun. 25, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A multiband antenna comprising:

at least two antenna elements for use in a low frequency band and a high frequency band;

a feeding point unit configured to be shared by both of the antenna elements for use in the low frequency band and the high frequency band; and an impedance matching unit configured to be inserted into and connected to a position between an end of the antenna element for use in the high frequency band on the side of the feeding point unit and an open end thereof, wherein an inductor is serially inserted into and connected to a position between the impedance matching unit and the open end of the antenna element for use in the high frequency band.

2. The multiband antenna according to claim 1, wherein the impedance matching unit is constituted by an LC parallel resonance circuit configured to operate as an inductor in a low frequency band and operate as a capacitor in a high frequency band.

3. The multiband antenna according to claim 2, wherein the inductor of the LC parallel resonance circuit is constituted by a conductor of a length sufficient to obtain a desired inductance and the capacitor of the LC parallel resonance circuit is constituted by opposed conductors with a space of a distance sufficient to obtain a desired capacitance interposed therebetween or conductors with a dielectric sandwiched therebetween within the space.

4. The multiband antenna according to claim 1, wherein the antenna element for use in the high frequency band is constituted by two or more antenna elements, and the two or more antenna elements for use in the high frequency band respectively share the feeding point unit with each other and the impedance matching unit is inserted into and connected to at least one of the two or more antenna elements.

5. The multiband antenna according to claim 1, wherein the antenna element for use in the high frequency band is constituted by two or more antenna elements, and the two or more antenna elements for use in the high frequency band are respectively constituted by a feeding point side antenna element connected to the feeding point unit and a ground side antenna element which is grounded at one end and is opposed to an open end of the feeding point side antenna element at the other open end with a space interposed between the open ends, and the impedance matching unit is inserted into and connected to the feeding point side antenna element.

6. The multiband antenna according to claim 1, wherein the open ends of the antenna element for use in the low frequency band and the antenna element for use in the high frequency band are disposed in opposition to each other.

7. A radio communication terminal comprising:

a multiband antenna including at least two antenna elements for use in a low frequency band and a high frequency band, a feeding point unit configured to be shared by both of the antenna elements for use in the low frequency band and the high frequency band and an impedance matching unit configured to be inserted into and connected to a position between an end of the antenna element for use in the high frequency band on the side of the feeding point unit and an open end thereof, wherein an inductor is serially inserted into and connected to a position between the impedance matching unit and the open end of the antenna element for use in the high frequency band.

* * * * *